United States Patent [19]

Smith

[11] Patent Number: 4,823,824

[45] Date of Patent: Apr. 25, 1989

[54] TENT CONSTRUCTION

[75] Inventor: Katharine F. Smith, Cranston, R.I.

[73] Assignee: Hasbro, Inc.

[21] Appl. No.: 234,954

[22] Filed: Aug. 22, 1988

[51] Int. Cl.[4] ..... E04H 15/00

[52] U.S. Cl. ..... 135/120; 135/96; 135/102

[58] Field of Search ..... 135/120, 102, 99, 100, 135/901, 96

[56] References Cited

U.S. PATENT DOCUMENTS

| | | | |
|---|---|---|---|
| 396,846 | 1/1889 | Ancel | 135/100 |
| 837,729 | 12/1906 | Reid | 135/100 |
| 960,849 | 6/1910 | Dilg | 135/120 |
| 2,601,865 | 7/1952 | Campbell | 135/99 |
| 3,875,952 | 4/1975 | Black | 135/120 |
| 4,192,333 | 3/1980 | Sato | 135/102 |
| 4,478,234 | 10/1984 | Bester | 135/901 |

*Primary Examiner*—J. Karl Bell

*Attorney, Agent, or Firm*—Salter & Michaelson

[57] ABSTRACT

A tent construction comprises a tent member including a frame portion and a fabric wall portion, and a periscope assembly adjacent the upper end of the tent member which permits a person inside the tent member to view the surrounding area. The periscope assembly includes a base portion which is secured to the frame portion of the tent member and a periscope portion which is rotatably received in the base portion so that it is operative for viewing the area surrounding the tent member.

8 Claims, 2 Drawing Sheets

TENT CONSTRUCTION

BACKGROUND AND SUMMARY OF THE INVENTION

The instant invention relates to tents, and more particularly to a tent construction which includes a tent member and a periscope assembly on the tent member which is operative for viewing the area surrounding the tent member.

Over the years, various tents have been found to have significant levels of play value for young children. In this connection, relatively small tents which are adapted to be alternatively erected indoors or outdoors have been found to have particularly high levels of play value since they can readily be incorporated in both indoor and outdoor play activities.

The instant invention provides a tent construction which is adapted for use by children and which can be alternatively erected indoors or outdoors but which has a substantially increased level of play value. Specifically, the instant invention provides a tent construction comprising a tent member of generally dome-shaped configuration and a periscope assembly which is assembled on the tent member so that it is operative for viewing the area surrounding the tent member. The tent member is preferably made in a collapsible construction, and it preferably includes a frame portion and a flexible wall portion which is supported on the frame portion. The frame portion preferably includes a plurality of elongated frame elements which extend upwardly to an uppermost point of the tent member, and the periscope assembly is preferably detachably mounted on the frame portion proximal the uppermost point of the tent member. The periscope assembly preferably includes a base portion which is detachably received on the tent member so that it covers the uppermost portion thereof, and a periscope portion which is rotatably received in the base portion so that it extends upwardly therethrough. Further, the periscope portion is adapted so that a person looking in a substantially horizontal direction into the lower end of the periscope portion can observe the area surrounding the tent member through the upper end of the periscope portion.

It has been found that the tent construction of the instant invention has a relatively high level of play value and that it represents a significant advancement over the heretofore available tent constructions. Specifically, it has been found that the periscope assembly of the tent construction of the instant invention significantly enhances the overall play value of the tent construction by enabling a child located within the tent member to view the area surrounding the tent member. As a result, the tent construction of the instant invention is adapted to be utilized in connection with a wide variety of new and different play activities, and it therefore represents a significant advancement over the heretofore available tent constructions.

The closest prior art to the subject invention of which the applicant is aware is disclosed in the U.S. Pat. Nos. 1,260,341 to Curtis; 2,043,019 to Swansey; and 3,951,160 to Nitu. However, these references fail to even remotely suggest the concept of incorporating a periscope into a tent; and hence, they are believed to be of only general interest with respect to the tent construction of the subject invention.

Accordingly, it is a primary object of the instant invention to provide a tent construction which has a substantially increased level of play value.

Another object of the instant invention is to provide a tent construction including a periscope assembly which is operative for viewing the area surrounding the tent.

An even further object of the instant invention is to provide a tent construction comprising a dome-shaped tent member and a periscope assembly which is mounted on the tent member and operative for viewing the area therearound.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
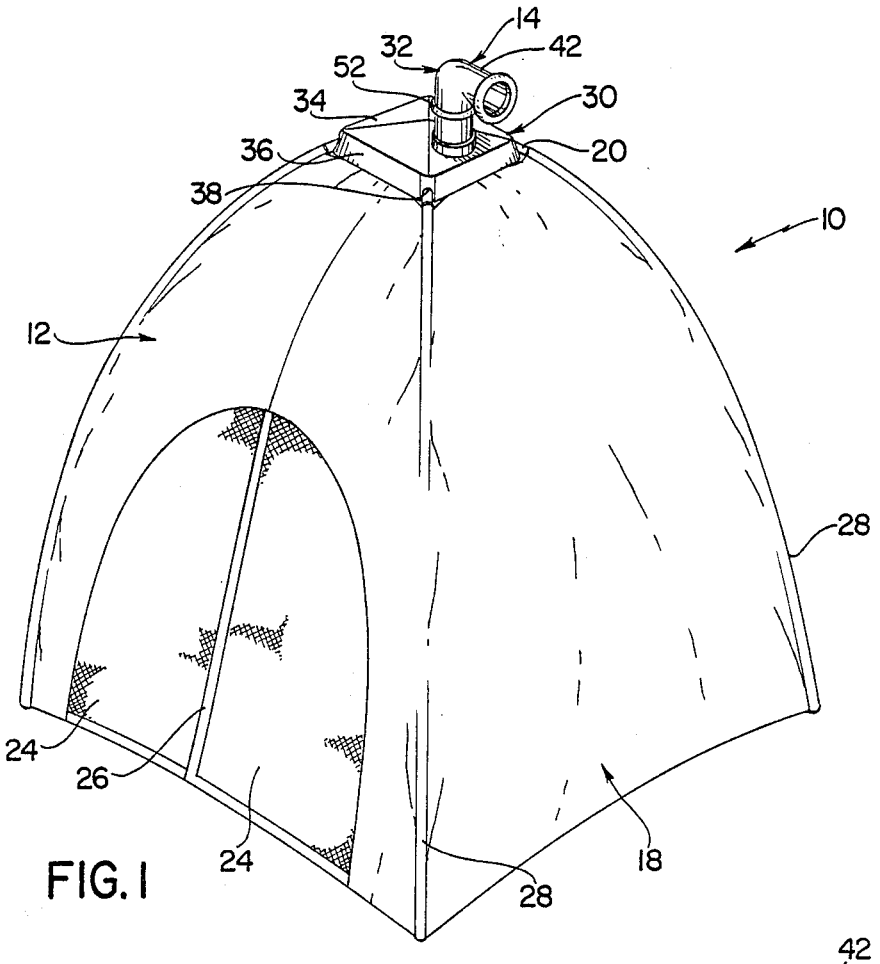
FIG. 1 is a perspective view of the tent construction of the instant invention.
Figure 2:
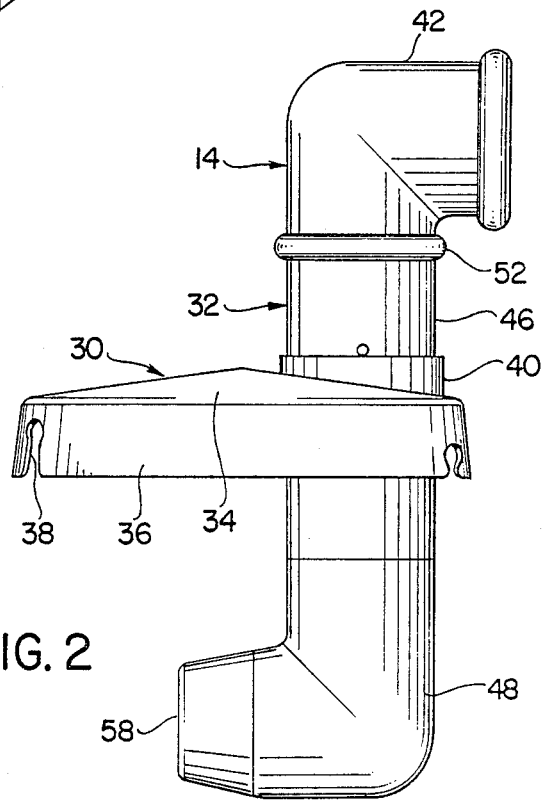
FIG. 2 is a side elevational view of the periscope assembly thereof.
Figure 3:
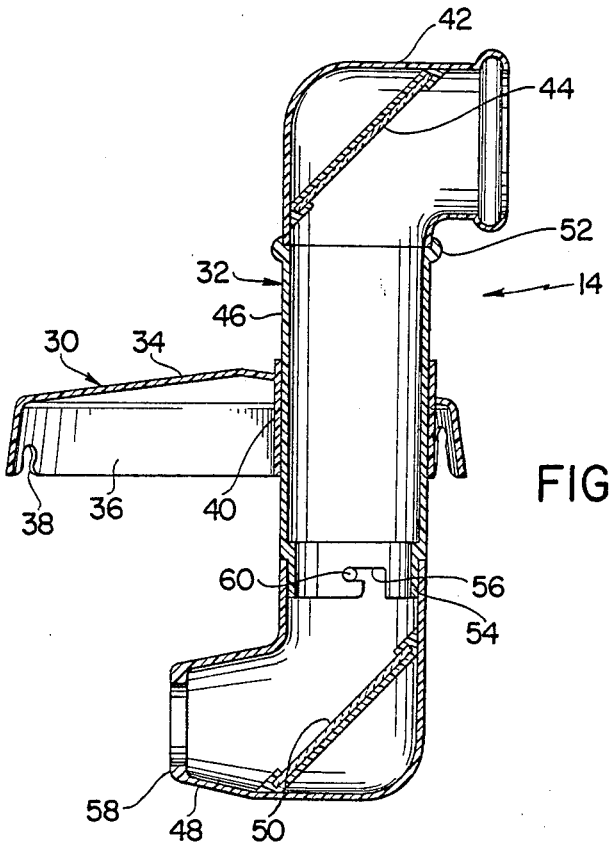
FIG. 3 is a side sectional view taken along line 3—3 in FIG. 4.

Referring now to the drawings, the tent construction of the instant invention is illustrated and generally indicated at 10 in FIG. 1. The tent construction 10 comprises a tent member generally indicated at 12 and a periscope assembly generally indicated at 14 which is assembled with the tent member 12 so that the periscope assembly 14 can be utilized for viewing the area surrounding the tent member 12.

Figure 4:
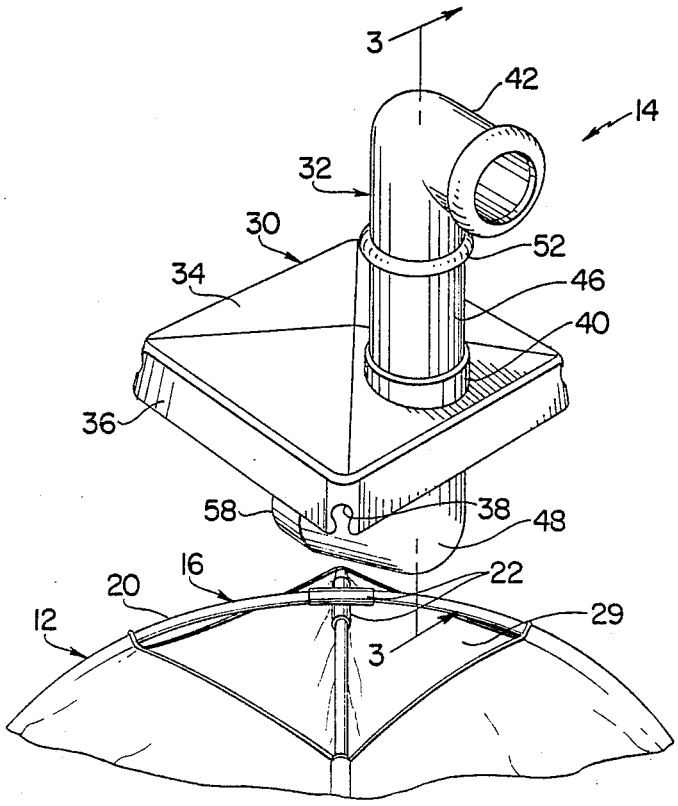
FIG. 4 is an exploded perspective view of the periscope assembly and the upper portion of the tent member.

The tent member 12 is of generally dome-shaped configuration as illustrated in FIG. 1, and it comprises a collapsible frame portion generally indicated at 16 in FIG. 4 and a wall portion generally indicated at 18. The frame portion 16 comprises four elongated tubular frame elements 20 which define the four corners of the tent member 12. The tubular frame elements 20 are preferably made of a material, such as fiberglass or a suitable plastic, in slightly, resiliently flexible constructions, and they extend upwardly and inwardly from the corners of the tent member 12, diagonally opposite frame elements 20 being joined with tubular sleeves 22 adjacent the apex or uppermost point of the tent member 12 as illustrated in FIG. 4. The wall portion 18 is preferably made from a suitable fabric, such as a nylon or Dacron (DuPont TM) fabric, and it includes a pair of door panels 24 which are made of a fabric screening material and detachably connected along a center strip 26. Accordingly, the door panels 24 can be alternatively separated to define a door opening in the wall portion 18 or they can be closed in the manner illustrated in FIG. 1. The wall portion 18 further comprises four tubular sleeves 28 which are defined by stitching or seams which extend along the four opposite corners of the tent member 12, and the frame elements 20 are received in the tubular sleeves 28 in order to retain the wall portion 18 in proper orientation on the frame portion 16. As illustrated in FIG. 4, an opening 29 is formed in the upper end portion of the wall portion 18 so that the periscope assembly 14 can be effectively secured to the frame elements 20. The tent member 12 is collapsible by moving an adjacent pair of the frame elements 20 together to fold the wall portion 18 into a substantially flat disposition.

The periscope assembly 14 comprises a base portion generally indicated at 30 and a periscope portion generally indicated at 32 which is rotatably received in the base portion 30. The base portion 30 is of generally rectangular configuration, and it is preferably integrally molded from a suitable plastic material. The base portion 30 comprises a topwall 34 and a sidewall 36 which depends downwardly from the perimeter of the top wall 34, and notches 38 are formed in the sidewall 36 at the four corners of the base portion 30. The base portion 30 is adapted to be assembled on the uppermost portion of the tent member 12 so that the frame elements 20 are received in the notches 38, and so that the base portion 30 substantially covers the opening 29. The base portion 30 further includes a tubular sleeve 40 which extends upwardly through the top wall 34 at a point which is offset from the center of the top wall 34 so that it does not interfere with the tubular elements 20. The periscope portion 32 comprises a tubular upper elbow section 42 having an angularly disposed upper mirror 44 mounted therein, a tubular intermediate section 46 and a tubular lower right angle viewing section 48 having an angularly disposed lower mirror 50 mounted therein. The upper elbow section 42, the tubular intermediate section 46, and the viewing section 48 are preferably all made of a suitable rigid, plastic material, and the elbow section 42 is permanently joined to the upper end of the intermediate section 46 by suitable means, such as an adhesive. A ring 52 is integrally formed in the tubular intermediate section 46 adjacent the upper end thereof, and a slightly reduced tubular section 54 having a bayonet slot 56 therein is formed in the lower portion of the intermediate section 46. The intermediate section 46 is rotatably and slidably received in sleeve 40 of the base portion 30 so that downward movement of the periscope portion 32 is limited by the ring 52. The viewing section 48 is also of right angular configuration; although, it includes an enlarged, rounded, open viewing end 58 which is adapted to permit an operator to view the mirror 50 with both eyes by positioning the cheek and forehead portions of the operator's face against the viewing end 58. The upper end portion of the viewing section 48 is received on the reduced portion 54 of the intermediate section 46, and a pin 60 extends inwardly in the upper end portion of the viewing section 48, so that it is receivable in the bayonet slot 56 for releasably securing the viewing section 48 to the intermediate section 46. The mirrors 50 and 44 are preferably positioned in substantially parallel relation at angles of approximately 45° to the longitudinal extent of the intermediate section 46, so that they cooperate to reflect the viewing picture in front of the upper elbow section 42 in order to enable an operator looking at the mirror 50 through the open end 58 to observe the area in front of the upper elbow section 42. Further, by rotating the periscope portion 32 in the sleeve 40, the viewing picture in front of the upper elbow section 42 can be changed so that the entire area surrounding the tent member 12 can be viewed in a similar manner.

It is seen therefore that the instant invention provides a tent construction having a substantially increased level of play value. Specifically, the periscope assembly 14 effectively allows a child inside of the tent member 12 to view the area surrounding the tent member 12 without being seen from outside thereof. Accordingly, the tent construction of the instant invention has a substantially increased play value as compared to conventional tents, and it can be utilized in connection with a wide variety of new and interesting play activities. For these reasons, as well as the other reasons hereinabove set forth, it is seen that the tent construction of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A tent construction comprising a tent member including a frame portion and a flexible wall portion supported on said frame portion, and periscope means operative from the interior of said tent member for viewing the area surrounding said tent member.

2. In the tent construction of claim 1, said periscope means being mounted on said frame portion.

3. In the tent construction of claim 1, said tent member being of generally dome-shaped configuration, said periscope means being mounted on said tent member proximal the uppermost point of said tent member.

4. In the tent construction of claim 1, said tent member being collapsible, said periscope means being detachably mounted on said frame portion.

5. In the tent construction of claim 4, said tent member being of generally dome-shaped configuration, said periscope means being mounted on said frame portion proximal the uppermost point of said tent member.

6. In the tent construction of claim 5, said frame portion comprising a plurality of elongated frame elements which extend upwardly to the uppermost point of said tent member, said periscope means being secured to said frame elements proximal the uppermost point of said tent member.

7. In the tent construction of claim 6, said periscope means including a base portion which is detachably received on said tent member so that it covers the uppermost portion thereof and a periscope portion which extends upwardly through said base portion.

8. In the tent construction of claim 7, said periscope portion being rotatable relative to said base portion.

* * * * *